US007241140B2

(12) United States Patent
Rohner et al.

(10) Patent No.: US 7,241,140 B2
(45) Date of Patent: Jul. 10, 2007

(54) BURNING OVEN

(75) Inventors: Gottfried Rohner, Altstätten (CH); Robert Grunenfelder, Eschen (LI)

(73) Assignee: Ivoclar Vivadent AG, Schaan (LI)

( * ) Notice: Subject to any disclaimer, the term of this patent is extended or adjusted under 35 U.S.C. 154(b) by 0 days.

(21) Appl. No.: 10/943,530

(22) Filed: Sep. 16, 2004

(65) Prior Publication Data

US 2005/0250067 A1 Nov. 10, 2005

(30) Foreign Application Priority Data

May 7, 2004 (DE) ..... 10 2004 022 487

(51) Int. Cl.
*F27B 3/02* (2006.01)

(52) U.S. Cl. ..... 432/159; 432/247; 432/253; 219/390

(58) Field of Classification Search ..... 432/120, 432/156, 159, 184, 247, 249, 253, 258; 219/390
See application file for complete search history.

(56) References Cited

U.S. PATENT DOCUMENTS 4,492,572 A * 1/1985 Linn ..... 432/263
4,828,490 A * 5/1989 Indig ..... 432/124
5,839,900 A * 11/1998 Billet et al. ..... 433/218
5,997,293 A * 12/1999 Grunenfelder et al. ..... 432/206
6,157,004 A * 12/2000 Bizzio ..... 219/390
6,252,202 B1 * 6/2001 Zychek ..... 219/390
6,528,440 B1 * 3/2003 Vilato et al. ..... 501/7
6,869,280 B2 * 3/2005 Fleischfresser ..... 432/259

FOREIGN PATENT DOCUMENTS

DE 44 28 282 A1 2/1996

* cited by examiner

*Primary Examiner*—Gregory Wilson
(74) *Attorney, Agent, or Firm*—John C. Thompson; Alan S. Kooman

(57) ABSTRACT

A burning oven is provided, and has a housing that surrounds a combustion chamber in which material that is to be burned can be introduced after the housing is opened and can be placed upon a combustion chamber base. A deposit element is disposed externally of the combustion chamber, and has a deposit surface that is formed at least partially of glass ceramic.

2 Claims, 5 Drawing Sheets

BURNING OVEN

CROSS-REFERENCE TO RELATED APPLICATIONS

This application claims foreign priority benefits under 35 U.S.C. §119 from German patent application Ser. No. 10 2004 022 487.0 filed May 7, 2004.

TECHNICAL FIELD

The present invention relates to a burning oven or kiln, which has a housing having a combustion chamber for the thermal treatment of material that is to be burned and that is in the form of dental restoration components, whereby the combustion chamber has a combustion chamber base.

BACKGROUND OF THE INVENTION

Burning ovens for dental materials are these days typically used with an oven hood having an integrated heating means. This construction principle is shown in U.S. Pat. No. 4,139,341, although predecessor constructions, for example pursuant to U.S. Pat. No. 657,202, have shown burning ovens having heating coils in the oven hood.

The material that is to be burned is typically introduced into the burning oven by raising the hood. For example, with the approach of U.S. Pat. No. 4,139,341 in this position of the oven hood the material that is to be burned, and that is placed upon the combustion chamber base, is easily accessible from all sides. It can be easily handled, and the heating means of the oven is well spaced from the material that is to be burned, so that the danger of the operator getting burned is low.

In addition, in this position the oven hood does not cool off much, so that this approach is particularly favorable with regard to practical handling and for achieving a good throughput.

A burning oven of the aforementioned type is also shown in U.S. Pat. No. 5,788,485, (an improvement of U.S. Pat. No. 4,139,341), which illustrates that it is known to provide deposit elements to the side of the combustion chamber base. Such deposit elements are particularly favorable when changing the material that is to be burned. For example, the new material that is to be burned is placed on the left deposit element. The oven hood is opened, and the finished burned material is placed upon the right deposit element using a suitable tool. Only after this is accomplished is the new material that is to be burned taken from the left deposit element and placed upon the combustion chamber base.

The deposited burned material can cool off on the deposit element until it is suitable for further processing. To be able to ensure this, and in particular to avoid tension cracks in the burned material, the deposit element is basically provided in such a way that it poorly conducts the heat away. This can occur in various ways. For example, a special temperature resistant lacquer can be applied to the upper side of the deposit element that makes the heat transfer between the burned material and the deposit element, the base body of which is made of steel, more difficult. The upper surface of the deposit element can also be profiled in a special manner in order to reduce the support surface between burned material and deposit elements.

Although in individual cases this leads to the burned material being seated in a somewhat wobbly fashion upon the deposit element, and in particular such that it moves during vibrations, such an approach is these days typically used, and in order to achieve an adequate resistance to heat transfer, the drawbacks that are connected herewith are tolerated.

Such a burning oven is also offered by the applicant under the designation Programat X1. To prevent the combustion chamber base from heating up the deposit elements, with such a burning oven a certain spatial separation is provided between the support element and the rim of the combustion chamber. On the other hand, it would be more favorable to have a smooth surface here, already for the reason of facilitating cleaning.

OBJECTS OF THE INVENTION

It is therefore an object of the present invention to provide a burning oven of the aforementioned general type that offers an improved handling during the changing and removal of the material that is to be burned from the oven, and in particular in this regard that is also less sensitive to disruption.

BRIEF DESCRIPTION OF THE FIGURES

This object, and other objects and advantages of the present invention, will appear more clearly from the following specification in conjunction with the accompanying schematic drawings, in which.

SUMMARY OF THE INVENTION

Figure 1:
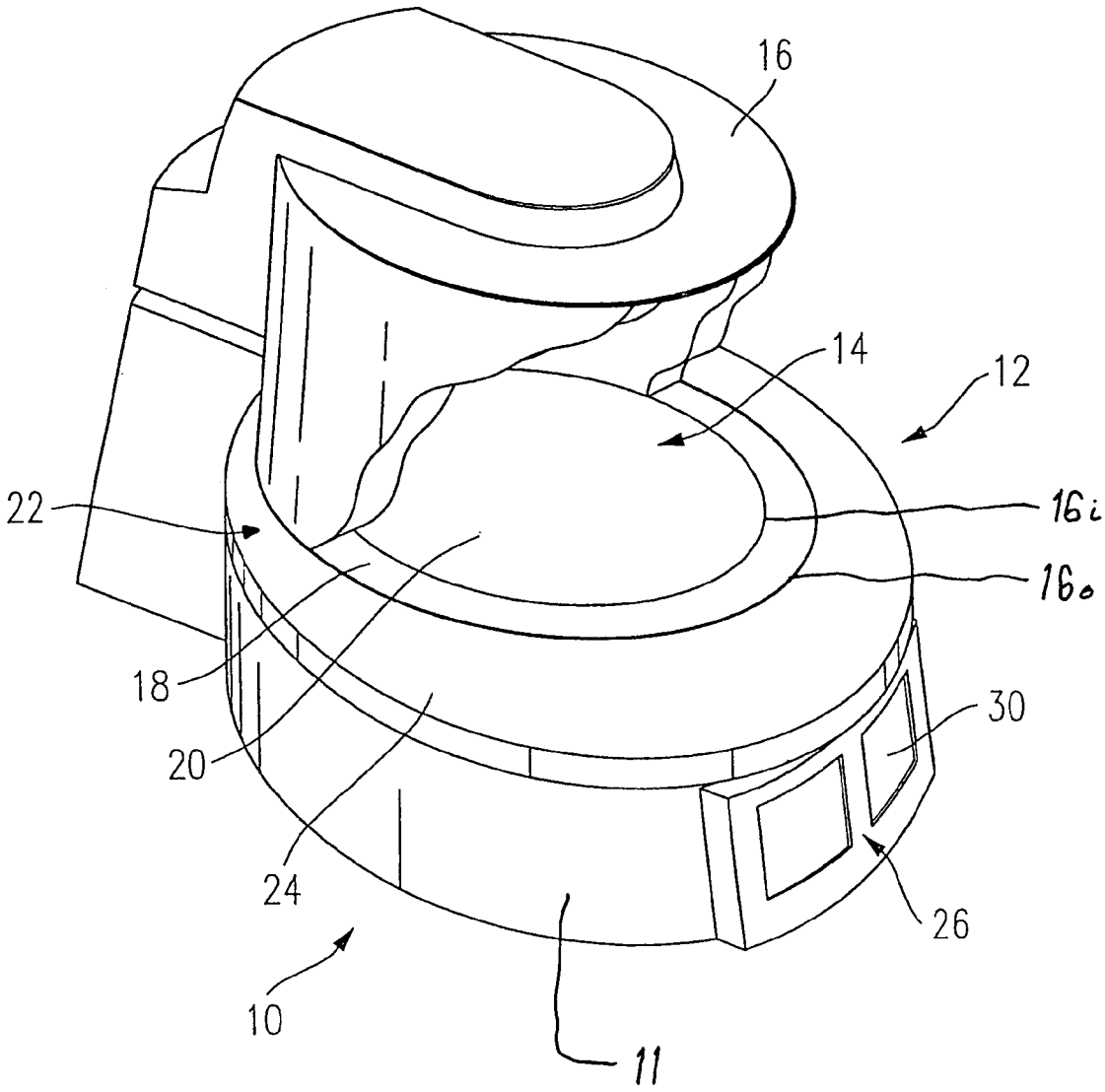
FIG. 1 is a view of one exemplary embodiment of an inventive burning oven, with the hood being partially broken away.

The burning oven of the present application is characterized primarily by at least one deposit surface for dental restoration components, wherein the deposit surface is formed at least partially of glass ceramic, and wherein the deposit surface is part of the burning oven or is connectable with the housing.

The inventive approach is characterized by the realization of a deposit surface that is comprised at least partially of glass ceramic and can, for example, form a deposit element externally of a combustion chamber. Glass ceramic typically has a smooth surface, thereby significantly improving the stability of material that is to be burned and that is placed upon the inventive deposit surfaces.

In contrast to coated metallic deposit surfaces, there is an additional advantage that glass ceramic is resistant to scratching, so that one does not need to expect that due to damage of the thermally insulating layer from the burned material point-type cold bridges result that adversely affect the desired thermal insulation.

It has been surprisingly shown that by placement of the material that is to be burned upon the inventive glass ceramic deposit surface, the material, which also comprises ceramic mixtures, cools off uniformly and in a low-stress manner, so that no tension cracks result.

Pursuant to the present invention, due to this realization of the glass ceramic deposit surface, the possibility is provided for having the deposit elements adjoin the combustion chamber base in a gap-free manner, since the inventive glass ceramic offers such a good thermal insulation that it is no longer necessary to have a spatial separation.

However, this also opens up the possibility of providing a large working surface that is then formed from the combustion chamber base and the surrounding glass ceramic deposit surface. This advantageous design, which is conditioned upon the deposit elements and the combustion chamber base extending at the same vertical height, also makes it possible to shift the material that is to be burned upon the combustion chamber base for charging the oven, and for sliding it away for removal. This results in the particular advantage of not having to raise the burned material, which up to now had to be effected, for example, with a wooden forceps or some other thermal insulating tool, so that with the present invention the danger is considerably reduced that the burned material can fall down or off and thereby become damaged. It has also been shown that during the deposit of the burned material unavoidable vibrations can be avoided as a consequence of the shifting or sliding movement.

Pursuant to an expedient inventive embodiment, the deposit surface extends at least partially, for example by 90° or 180°, about the combustion chamber in order in this way to permit a large and ergonomic working surface that can be manipulated.

In a modified embodiment, two deposit surfaces of the deposit element are offset in height relative to one another, so that preparatory activity can be undertaken upon the additional, lower deposit surface.

In a further modified embodiment, a portion of the deposit surface is pivotable relative to the oven support, and in particular preferably about a vertical axis. This permits, for example, a mixing of dental materials to be undertaken upon the pivoted-out region, i.e. in a clear separation from the rest of the burning oven.

It is to be understood that pursuant to the invention in a particularly favorable manner the burning oven is comprised of an inwardly heated oven hood, which surrounds the material that is to be burned, and an oven support that generally has its own heating means.

Due to the one-piece configuration of deposit elements and combustion chamber base, there are additional cost advantages, since it is no longer necessary to have a special securement of the deposit elements separately from the combustion chamber base.

In a further modified embodiment, preferably concave recessed areas are provided in the deposit surface that can serve for the mixing of dental materials.

The inventive glass ceramic is resistant to temperature at the temperatures that occur, has a smooth surface, and can be realized by the glass ceramic that is customarily used for forming Ceran® cooking fields or arrays of household ranges.

To increase even further the horizontal heat transfer resistance, it is also possible to selectively provide annular recesses on the underside of the glass ceramic plate that can be provided approximately at the transition between the deposit surface and the combustion chamber base.

Such recesses do not adversely affect the smooth upper side of the glass ceramic. The glass ceramic is typically colored red, and is therefore readily transparent for infrared radiation, so that it is also possible to heat the combustion chamber base if the glass ceramic also extends there.

The glass ceramic is expediently translucent or even transparent, so that even indicating means provided below the glass ceramic are visible, or control units can be actuated. For example, light elements can at the same time also be protected and covered by the glass ceramic. As is known, control elements can also be realized that can be actuated markedly robustly through the glass ceramic.

In a further modified embodiment, a temperature sensor is provided that controls the color of the light elements as a function of the measured temperature in the inner space, or possibly of the temperature of the deposit surface. The operator thus immediately optically obtains an appropriate signal whether or not the inventive burning oven is in operation. Furthermore, further dental-related information and indicators can also be integrated into the deposit surface; for example, burning program information or a color key to the dental ceramics that are used.

If the deposit element is detachably secured to the oven support, different deposit elements can be made available for different dental materials, and hence appropriate control programs can be initiated in the burning oven. It is also possible to already undertake other preparations on the deposit element in a state where it is detached from the burning oven.

In a further embodiment, a peripheral seal is provided on a peripheral outer rim of the oven hood. This seal undergoes relatively little thermal stressing since it is clearly spaced from the combustion chamber and also permits a combustion in the oven in a partial vacuum.

In a further modified embodiment, the deposit element is detachably secured to the housing, and can be exchanged depending upon the dental material that is used. By means of an appropriate coating, control information for the burning oven can then be automatically made available.

In a further modified embodiment, the deposit element is disposed concentrically relative to the combustion chamber base.

Further specific features of the present invention will be described in detail subsequently.

DETAILED DESCRIPTION

Referring now to the drawings in detail, the burning oven or kiln illustrated in FIG. 1 is indicated generally at 10 and has support 11, and a housing indicated generally at 12 that provides a combustion chamber indicated generally at 14. The housing 12, in turn, has a heated oven hood 16 and an oven support 18. The rearward region of the oven hood 16 is pivotally mounted on the oven support 18, whereby it is to be understood that in place of such a pivotable mounting a lifting/swinging mourning can also be realized. The oven hood 16 forms an upper portion of the housing 12, and the oven support 18 forms a lower portion of the housing. In the closed state of the burning oven, the combustion chamber 14 is therefore prescribed by the inner space of the housing. In FIG. 1 the lines **16*o* and 16*i* represent the inner and outer surfaces of the hood when in contact with the surface 24, and do not represent seams. Thus the surface 24** is seamless. Therefore, it can be seen that the combustion chamber base and the deposit surface are monolithically formed.

In FIG. 1, the oven hood 16 is partially broken away, thus exposing the view of a combustion chamber base 20 that is flat and extends horizontally. In a manner known per se, the oven hood 16 is provided with lateral heating coils that surround the material that is to be burned and that has been placed upon the base 20 of the combustion chamber 14. In contrast, in the illustrated embodiment the combustion chamber base 20 is free of heating elements.

Adjoining the combustion chamber base 20 to the side and toward the front is an inventive placement or deposit element indicated generally at 22, which in the illustrated embodiment is comprised of a single deposit surface 24. As can be seen, the deposit element projects beyond the support 11. It is to be understood that in place of a single deposit surface a plurality of deposit surfaces that are separated from one another could also be provided, which would still be within the scope of the present invention.

In the illustrated embodiment, the deposit element 22 extends over an angle of more than approximately 270°, in other words, nearly over a circle about the base of the combustion chamber. The deposit surface 24 thereof directly adjoins the combustion chamber base 20 at the same vertical height as is the base 20.

Pursuant to the present invention, the deposit element 22 is made of glass ceramic that is at least translucent or transparent, or is pigmented, and which enables the material that is to be burned to be introduced at that location in a manner free from vibration. The lack of vibration comes about in that the deposit surface 24 is smooth, since it is made of glass ceramic, thus enabling a shifting from the combustion chamber base 20 to the deposit surface 24 in a single movement.

From FIG. 1 it can also be seen that provided below the forward region of the deposit element 22 are control elements indicated generally at 26, which can also include indicators 28 and 30 (see also FIG. 5). Due to the projection of the deposit element 22, the control element 26 is well protected, especially against the foreseeable falling-down of hot burned material, which to this extent can cause no damage to the control element 26.

Figure 2:
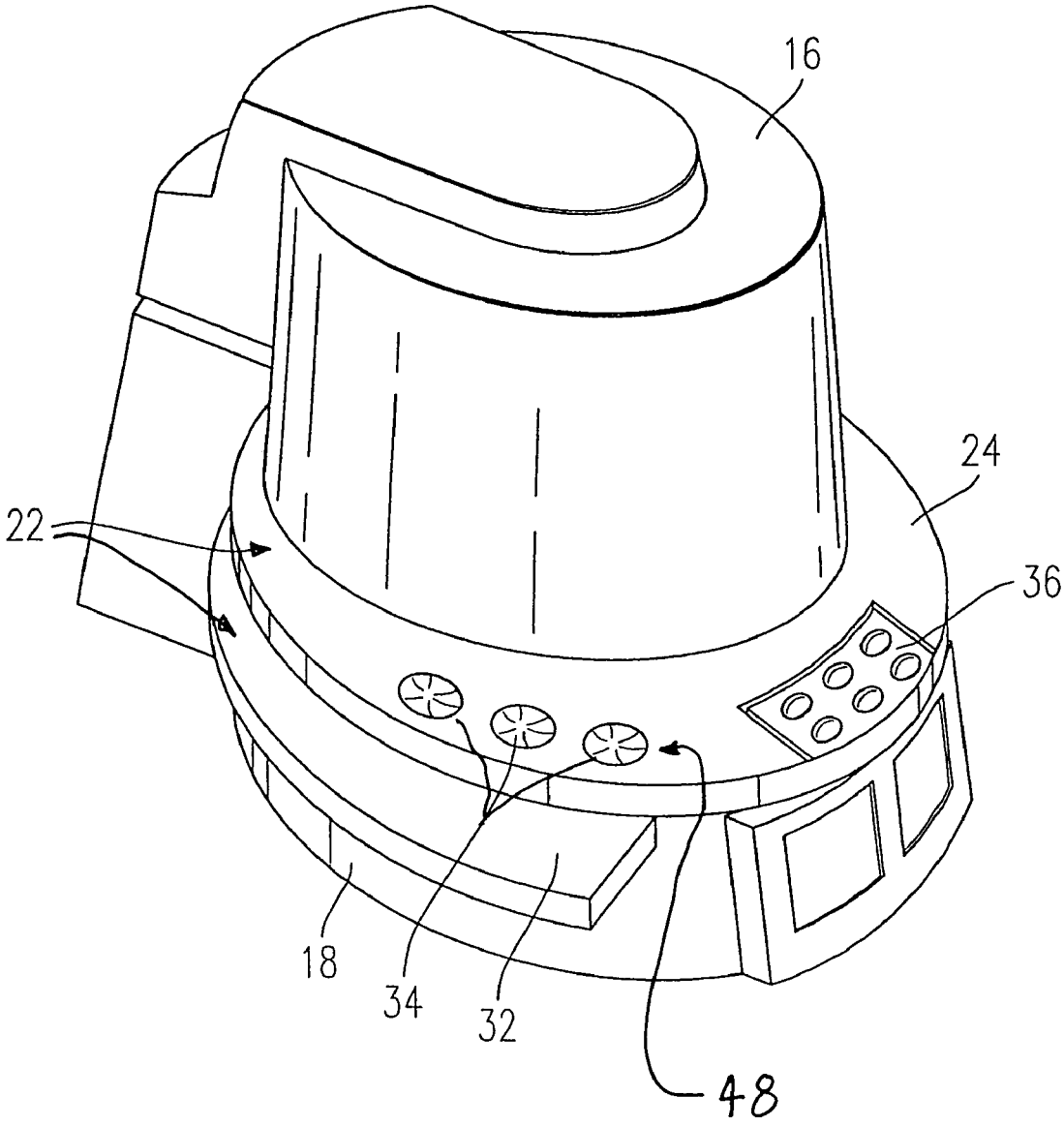
FIG. 2 is a modified embodiment of the burning oven of FIG. 1.

A further modified embodiment of the inventive burning oven can be seen from FIG. 2. In contrast to the embodiment of FIG. 1, with this embodiment the deposit element 22 is in two parts having separate deposit surfaces 24 and 32. Thus, in addition to the deposit surface 24, it has a deposit surface 32 that extends below the deposit surface 24, but does not project above the latter. The deposit surface 32 enables preparatory measures for making the inventive dental material available.

The deposit surface 24 is furthermore provided with a mixing region indicated generally at 48, the region having recessed areas 34 that can be used, for example, for the mixing of dental materials. The recessed areas may be concave. An additional control element field 36 is integrated into the front region of the deposit surface 24 of glass ceramic. For example, keys can be activated without contact or by the approach of a human figure, as has become known with household ranges having a so-called Ceran® cooking top, field or array. The glass ceramic preferably has a smooth surface and is heat resistant to at least 600° C.

The same reference numerals also indicate the same or similar components in the further figures.

Figure 3:
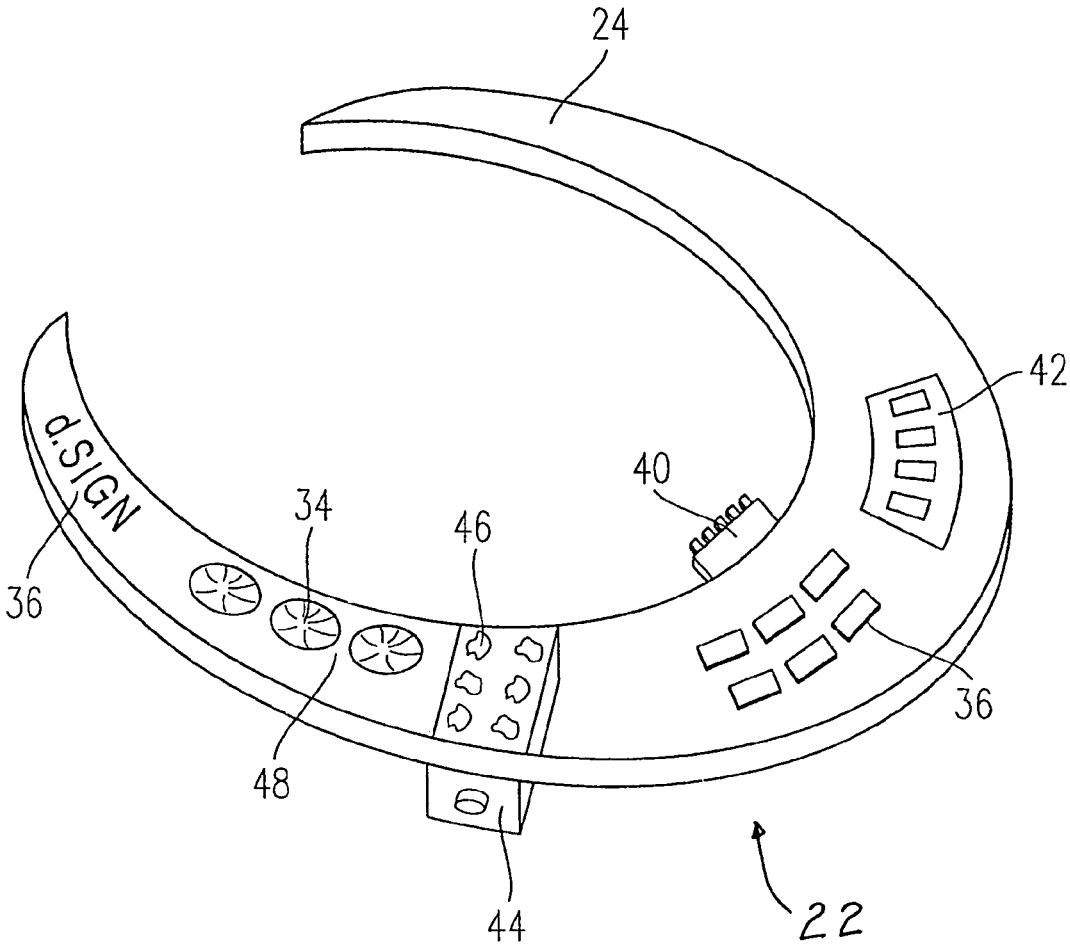
FIG. 3 is a further modified embodiment of the inventive burning oven, whereby merely one detail, namely the inventive deposit surface, is illustrated.

FIG. 3 shows a further modified embodiment of an inventive burning oven. With this embodiment, where merely a deposit element 22 is illustrated, the deposit element is replaceable or exchangeable, thus providing various possibilities as a function of the burning program and/or dental materials that are to be used. This is true for a number of reasons. On the one hand, a designation field 36 is provided for each deposit element, which in the illustrated embodiment is labeled with "d.SIGN", a proven dental material, in order to indicate the designation for this dental material.

A coding is effected via a plug 40, so that as a function of the preselected dental material, the burning program is established and coordinated.

Further auxiliary means or aids are also integrated into the deposit element 22 with this embodiment. For example, a color key 42 is provided that makes it possible to control the selected tooth colors. A control element 36 has a number of switching or operating surfaces that make it possible, for example, to also alter the selected burning program as a function of user-related parameters. A drawer 44 is suspended on the deposit element. The deposit element 22 is translucent or transparent, so that it is possible to see, for example, various powders 46 in the drawer 44 through the deposit surface 24.

In addition, a mixing region indicated generally at 48 is provided, the region having a plurality of recessed areas 34 is provided next to the drawer 44.

When using a different dental material, a different deposit surface 24 that is adapted to this dental material is quickly placed on and is mounted on the burning oven housing.

Figure 4:
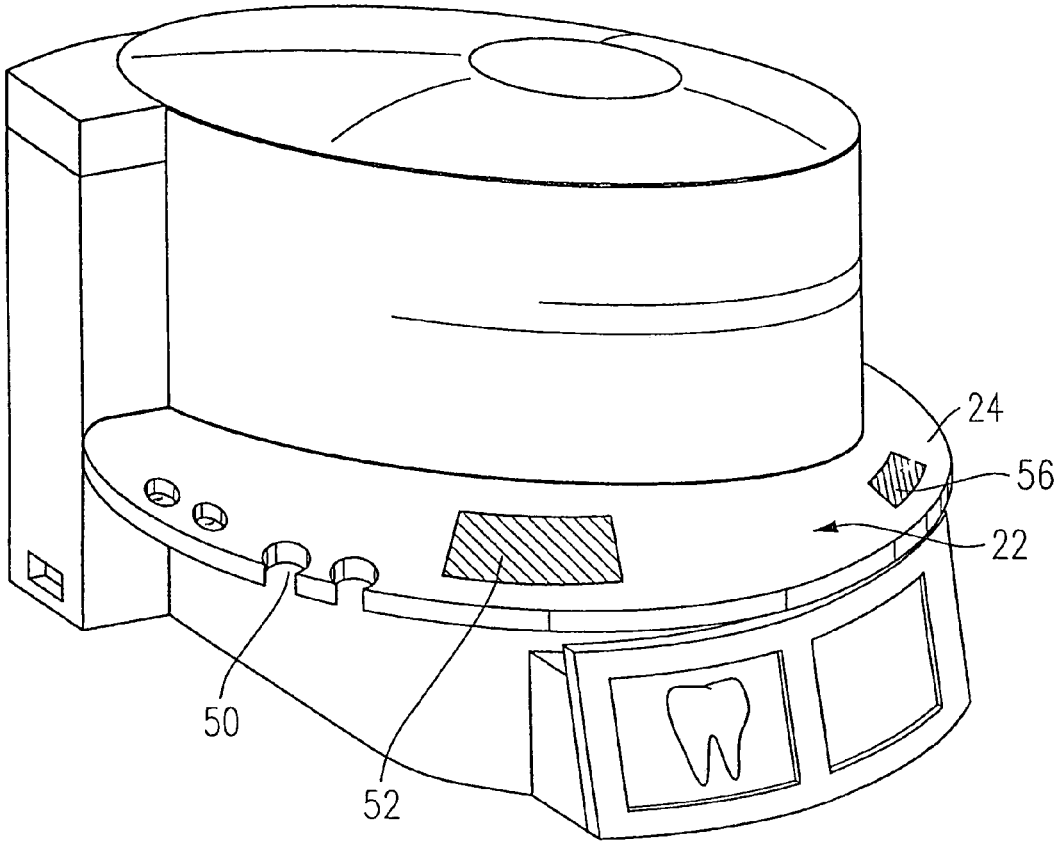
FIG. 4 shows a fourth embodiment of an inventive burning oven.

A further embodiment of an inventive burning oven is shown in FIG. 4. With this approach, the inventive deposit element 22 is provided with further components. Formed in the rear region are various recesses as tool receivers 50. Here, for example, tools for handling hot dental materials can be orderly arranged, yet are readily accessible. Approximately in the middle of the side a heating surface 52 is provided that is integrated into the deposit element. Material that is to be burned that is placed here can be preheated before it is introduced into the combustion chamber in order to thereby keep the thermal stresses as low as possible.

It would also be possible to integrate into the deposit surface 24 various indicating elements to reproduce burning curves and the like, whereby the indicating elements are at the same time well protected by the glass ceramic plate.

Disposed opposite the heating surface 52 on the right side of the deposit surface 24 is a temperature detection surface 56 that via a temperature sensor reads the temperature of the burned material placed there and, for example, gives off a release signal if the burned material has cooled off to such an extent that safe, further handling is possible.

This can also take place, for example, in that the color of at least one region of the deposit element changes from red to green.

Figure 5:
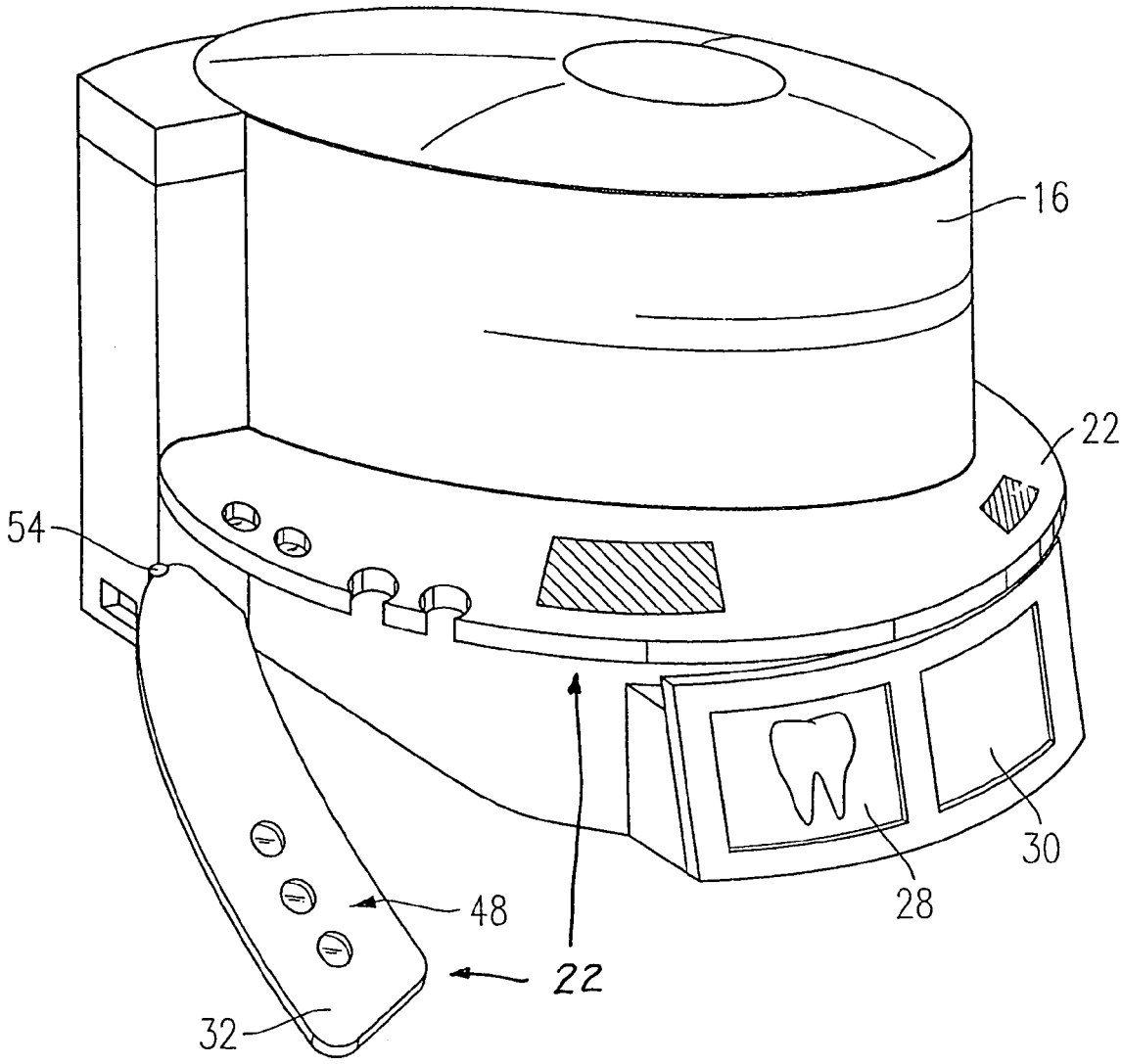
FIG. 5 shows a final embodiment of the inventive burning oven.

A further embodiment that is similar to the embodiment of FIG. 4 is shown in FIG. 5. Here a further deposit surface 32 is provided below the deposit surface 24 as part of the deposit element 22. The lower deposit surface 32 is pivotable about a vertical axis via a pivot bearing 54, so that its mixing region 48 can be brought a clear and safe distance from, for example, the hot oven hood 16.

While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims. In this regard, the term "means for" as used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed is:

1. A burning oven, comprising:

a housing having a combustion chamber for a thermal treatment of material to be burned that is in the form of dental restoration components, wherein said combustion chamber has a base; and at least one deposit surface for said dental restoration components, wherein said at least one deposit surface is formed at least partially of glass ceramic, wherein said at least one deposit surface is part of said burning oven or is connectable to said housing, wherein said deposit surface extends at least partially to one side of said combustion chamber, and wherein a deposit element for said at least one deposit surface is provided with at least one control element that in particular is integrated into said deposit element and/or can be activated through said glass ceramic.

2. A burning oven comprising:

a housing having a combustion chamber for a thermal treatment of material to be burned that is in the form of dental restoration components, wherein said combustion chamber has a base; and at least one deposit surface for said dental restoration components, wherein said at least one deposit surface is formed at least partially of glass ceramic, wherein said at least one deposit surface is part of said burning oven or is connectable to said housing, wherein said deposit surface extends at least partially to one side of said combustion chamber, and wherein disposed adjacent to said at least one deposit surface is at least one light element, the discharge light of which passes in particular through a portion of said at least one deposit surface.

* * * * *